US006401984B1

(12) United States Patent
Jumel

(10) Patent No.: US 6,401,984 B1
(45) Date of Patent: Jun. 11, 2002

(54) CONTAINER EQUIPPED WITH A DISPENSING NOZZLE WITH RETRACTABLE COVER

(75) Inventor: Stephane Jumel, Rémy (FR)

(73) Assignee: Beaute Prestige International, Paris (FR)

( * ) Notice: Subject to any disclaimer, the term of this patent is extended or adjusted under 35 U.S.C. 154(b) by 0 days.

(21) Appl. No.: 09/424,869

(22) PCT Filed: Apr. 9, 1999

(86) PCT No.: PCT/FR99/00834

§ 371 (c)(1),
(2), (4) Date: Dec. 9, 1999

(87) PCT Pub. No.: WO99/52782

PCT Pub. Date: Oct. 21, 1999

(30) Foreign Application Priority Data

Apr. 10, 1998 (FR) ..... 98 04578

(51) Int. Cl.[7] ..... B65D 23/08

(52) U.S. Cl. ..... 222/183; 222/325; 222/402.12

(58) Field of Search ..... 222/183, 320, 222/321.1, 321.6, 321.7, 321.8, 321.9, 322, 325, 402.1, 402.12, 402.13, 402.24

(56) References Cited

U.S. PATENT DOCUMENTS 5,226,563 A * 7/1993 Coggiola ..... 222/183
5,358,147 A * 10/1994 Adams et al. ..... 222/183
5,487,489 A * 1/1996 Weiss et al. ..... 222/183

FOREIGN PATENT DOCUMENTS

EP 0439034 7/1991
FR 2686002 7/1993

* cited by examiner

*Primary Examiner*—J. Casimer Jacyna
(74) *Attorney, Agent, or Firm*—Dennison, Scheiner & Schultz

(57) ABSTRACT

The present invention concerns a container of the type made up of a receptacle (2) hermetically containing a product (3) in a liquid, gas or pasty state to be distributed, an end piece (4) for distributing the product (3) and means for protecting the distribution end piece (4).

The means for protecting the distributor end piece (4) are made up of a sleeve (8) able to slide freely on said end piece (4) by means of activation means (9A, 9A', 9B, 9B') belonging to it so that said sleeve (8) automatically ensures protection by covering the end piece (4) when the container (1) is placed, or on the other hand freeing it under solely the effect of the inertia of the sub-unit (8-9-11).

20 Claims, 4 Drawing Sheets

CONTAINER EQUIPPED WITH A DISPENSING NOZZLE WITH RETRACTABLE COVER

BACKGROUND OF THE INVENTION

The present invention can be applied to the field of containers, of the type constituted by a receptacle hermetically containing a product in a liquid, gas or pasty state to be distributed, and an end piece for distributing the product embodied at an upper end portion of the receptacle.

The invention is also applicable either to a container whose distribution end piece is simply made up of a retracted neck of a receptacle needing to be opened or closed, or to a vaporiser.

In this latter case, a pump is mounted, fixed or clipped in a known way onto the neck of the receptacle and can be manually activated by pressing on a thrustor comprising a spray nozzle, nozzle or delivery tube for freeing the product.

The pump can be activated by exerting successive pressures on the distributor end piece when the latter controls a pump.

Regardless of the type of distribution end piece at the upper portion of the container, it is still necessary to protect it to preserve the product in the receptacle or, in the case of a sprayer, to protect the thrustor.

This is why the containers comprise means for protecting their associated distribution end piece, generally constituted by caps able to be directly screwed onto an external peripheral portion of the neck which is threaded so as to co-operate on screwing with a corresponding threaded bore embodied in a bore of said cap.

Depending on the case, these caps could also be forcefully engaged by means of elastic catching means fitted inside the cap co-operating with corresponding rigid means obtained with material or mounted on the neck of the receptacle for receiving the cap.

The distribution end piece mentioned above, frequently used in the field of perfumes, also requires to be protected and for this reason, generally speaking these types of caps and mainly used to avoid accidental propulsions able to occur on the thrustor of the pump when the container is located in a luggage item, handbag or even in a toilet case.

Also, to ensure the general aesthetic aspect of the container, the pump must be hidden by a given cap when the container is placed on a support and is not used.

Of course, in the case of a cap for a vaporiser, it is also necessary to create closing means as mentioned above ensuring the effective link between the cap and the container, these means in order to be embodied resulting in the implementation of a costly and complex set of tools, also requiring specialised workmanship.

Moreover, for the user, all the cap closing devices involve rotating movements when it concerns a cap to be screwed or even axial forces when fixing the cap by clipping it onto the neck of the receptacle.

SUMMARY OF THE INVENTION

The object of the present invention is to offer a container whose distribution end piece would be effectively protected by efficient and functional distribution means not requiring any intervention or handling by the user and being implemented automatically.

To this effect, the invention concerns a container of the type constituted by:

a receptacle hermetically containing a product to be distributed in a liquid, gas or pasty state;

an end piece for distributing the product embodied at one upper extremity portion of the receptacle and constituted by a narrow neck of the latter able to be open or closed or involving a vaporiser by a pump mounted on a neck and able to be manually activated by exerting pressure on a thrustor comprising a spray nozzle, nozzle or delivery tube for freeing the product.

Means for protecting the distribution end piece.

characterised in that the distributor end piece protection means are constituted by a sleeve having a corresponding shaped section, able to slide freely on said end piece close to the upper extremity of the receptacle, by means of activation means belonging to it and also extend freely to the other opposing extremity of the receptacle, beyond its lower plane, so as to constitute with the sleeve, a sub-unit forming a certain mass free on ascent or descent with respect to the receptacle, so that said sleeve automatically ensures protection via the side peripheral covering of the end piece when the container is laid on a fixed support, or on the other hand when being freed at least under the sole effect of the inertia of the sub-unit when it is lifted up from said support, during use.

Indeed, the major advantage of the invention resides in the fact that the distribution end piece, such as a vaporiser, is effectively protected by the sleeve able to be automatically retractable and serving as a cap without actually being one.

The present invention also concerns the characteristics inherent in the following description and need to be considered separately or according to their possible technical combinations.

BRIEF DESCRIPTION OF DRAWINGS

This description, given by way of non-restrictive example, shall be more readily explain how the invention can be embodied with reference to the accompanying drawings on which.

DETAILED DESCRIPTION OF THE INVENTION

Figure 1:
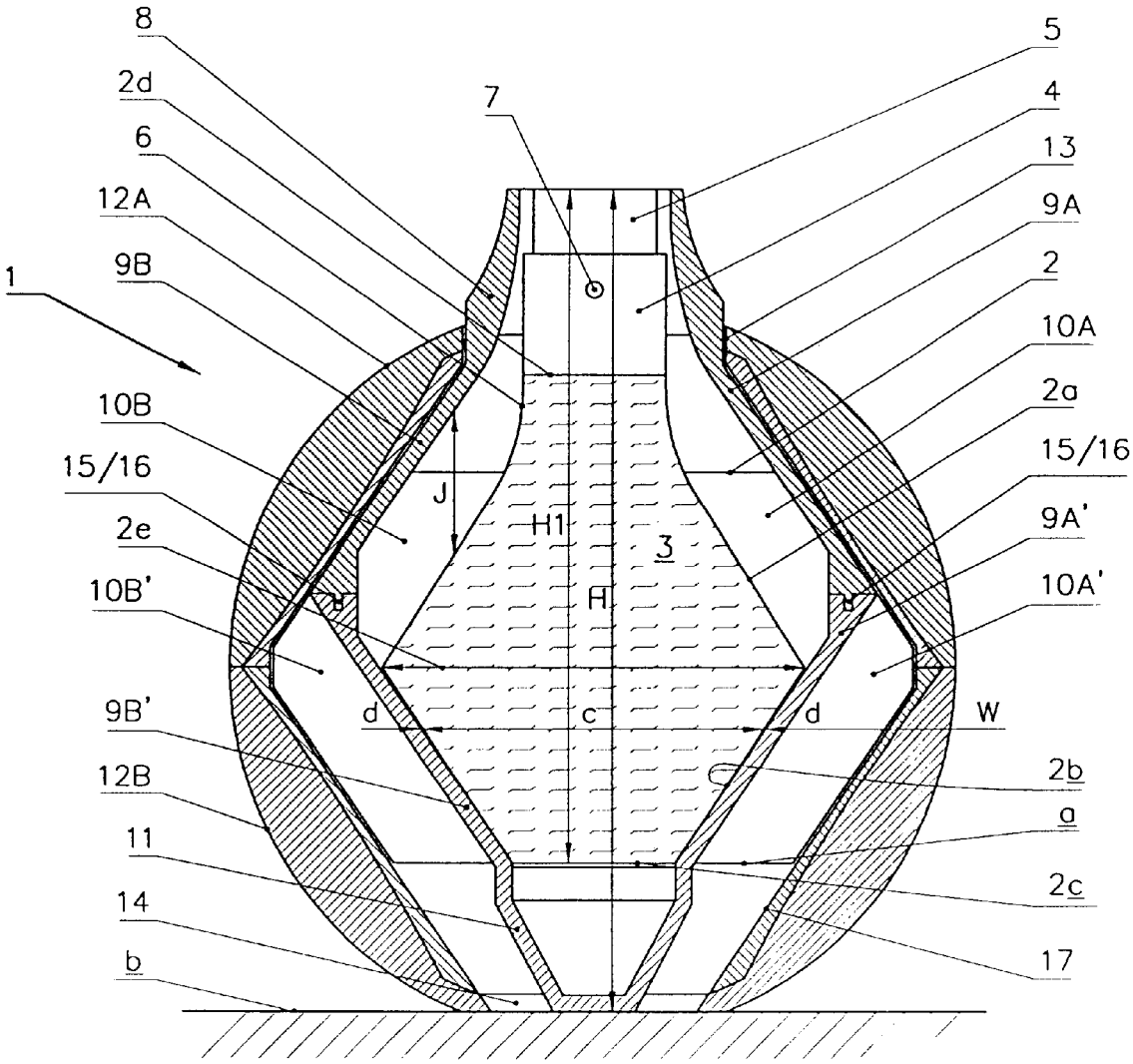
FIGS. 1 and 2 show as a vertical section a container according to one embodiment example of the invention, respectively in the unused position and use position of the distribution end piece, in this instance being a vaporiser.
Figure 2:
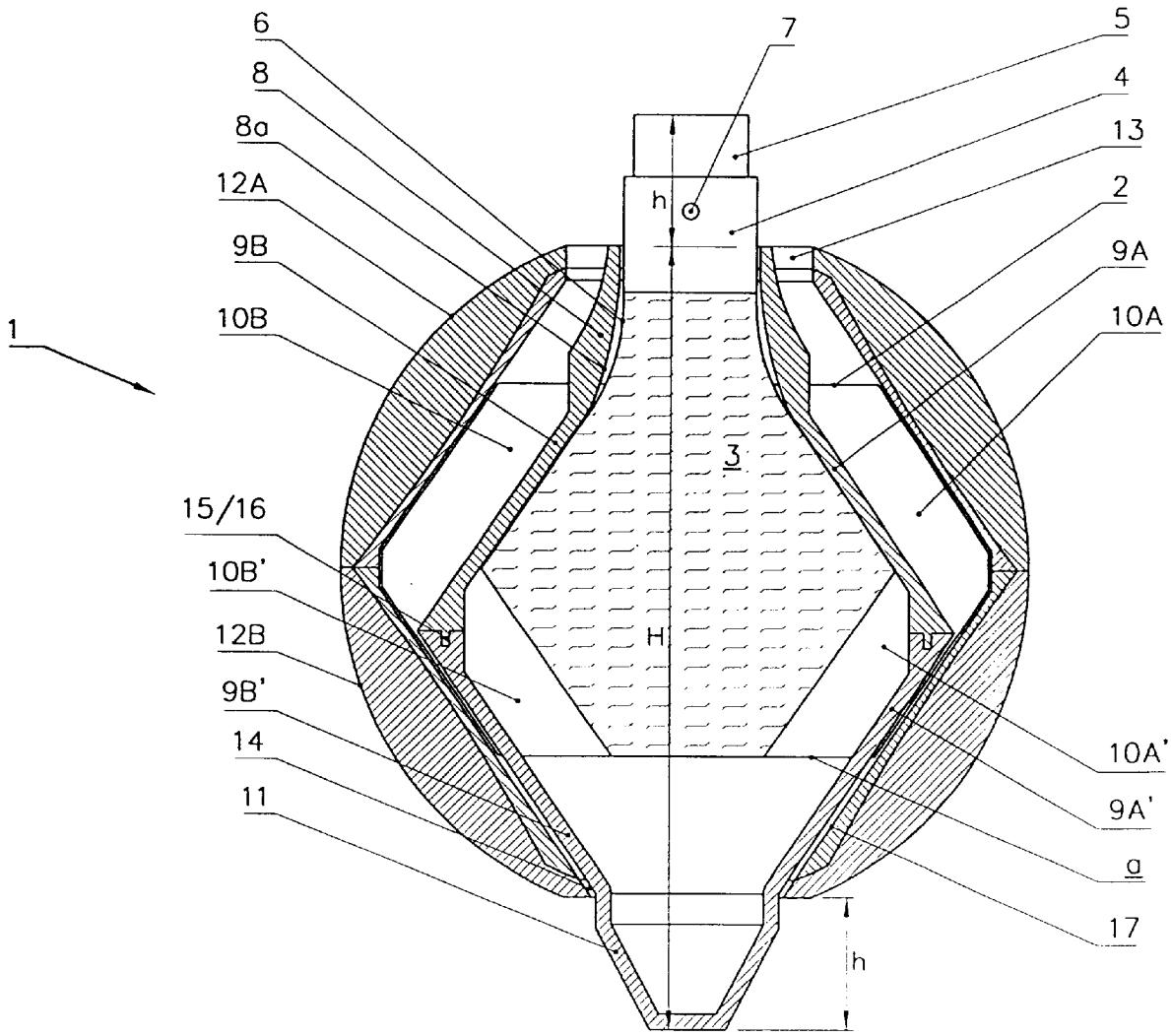

The container 1 of the invention shown on all the figures, is firstly constituted, by a receptacle 2 hermetically containing a product 3 in a liquid, gas, or pasty state to be distributed, and secondly an end piece 4 for distributing the product embodied at the upper extremity portion of the receptacle 2 and constituted in this case, involving a vaporiser by a pump 4 mounted on a narrow neck 6 of the receptacle 2 and able to be activated manually by exerting pressure on a thrustor 5 comprising a spray nozzle, nozzle or delivery tube 7 for freeing of product 3.

According to the invention, the container 1 comprises means for protecting the distribution end piece 4 and constituted by a sleeve 8 having a section with a corresponding shape able to slide freely on said end piece 4 close to the upper extremity of the receptacle 2 by means of activation means 9A, 9A', 9B, 9B' belonging to it and which also extend freely to the other opposite extremity of the receptacle 2 beyond its lower plane a so as to constitute with the sleeve 8 a sub-unit 8-9 forming a certain mass free when it ascends and free when it descends with respect to the receptacle 2, so that said sleeve 8 automatically ensures automatically the protection via the side peripheral covering of the end piece 4 when the container 1 is laid on a fixed support b, or on the contrary, it's freeing at least under the only effect of the inertia of the sub-unit 8-9 when it is lifted up from the support b during use.

According to the embodiment example shown on the figures, the means for activating the sleeve 8 are constituted by, at least, two diametrical lateral arms 9A, 9B prolonging the sleeve 8 at its lower position 8*a* and rejoining by two opposing arms 9A', 9B' under the receptacle 2 they surround and with respect to which they slide freely by means of two corresponding slides 10A, 10B–10A', 10B' provided on the external lateral faces of said receptacle 2 and with which they co-operate.

Again, according to the selected embodiment example, the lateral arms 9A, 9B and 9A', 9B' constituting the means for activating the sleeve 8 are inscribed in a geometric figure identical to the one in which the corresponding slides 10A, 10B and 10A', 10B' of the receptacle 2 are inscribed, their spacing c in a transverse direction, for a given contact line w, being approximately corresponding to that of the bottom of the slides they marry, when a clearance j is provided in the axial direction, equivalent to the desired travel, and which is at least equal to the height h of the visible portion of the pump to be protected or freed.

According to another characteristic of the invention, the total height H' of the sub-unit formed by the upper lateral arms 9A, 9B mounted over the sleeve 8 and by the lower lateral arms 9A', 9B', that is the height between the top of the sleeve 8 and the opposing extremities of the lower lateral arms 9A', 9B' is at least equal to the sum of the height H1 of the receptacle 2, the distributor end piece 4 included, and the vertical play j predetermined according to the value of the desired sliding of the protection sleeve 8.

As the set of drawings clearly shows, the geometric figure in which the receptacle 2 is inscribed, is basically made up of two truncated cones 2*a,* 2*b,* linked together by their large circular base 2$^{e}$ whose basic lengths L are identical, the small base 2*c* of one 2*b* being contained and constituting the bottom of the receptacle 2, whereas the small base 2*d* of the other 2*a* is open to jointly receive the end piece of the distributor 4.

Owing to the above and in a logical way, the geometrical figure in which the activation arms 9A, 9B, 9A', 9B' of the sleeve 8 are inscribed is generally constituted by a rhombus topped by said sleeve 8, basically cylindrical, and connected at their lower extremities by a truncated lengthening piece 11.

Again, according to the present non-restrictive embodiment example, the receptacle, partially surrounded by the sub-unit sleeve 8/activation arm 9 is contained inside a basically spherical external element 12A, 12B constituting both the decorative covering of the unit and a grasping of the latter, said spherical external decorative element 12A, 12B fixedly containing the receptacle 2 of the product 3, only the sub-unit sleeve 8/activation arm 9 being free to slide axially there from bottom to the top or conversely, firstly via its axial clearance play j in the grooves 10 of said receptacle 2 and an upper concentric opening 13 through which the distributor end piece 4 continuously opens and the sleeve 8 according to an occasional frequency, and secondly by means of a lower concentric opening 14 through which the lengthening piece 11 opens, again according to the same occasional frequency, formed at the opposing extremities of the activation arms 9A', 9B' of said sleeve 8.

Figure 3:
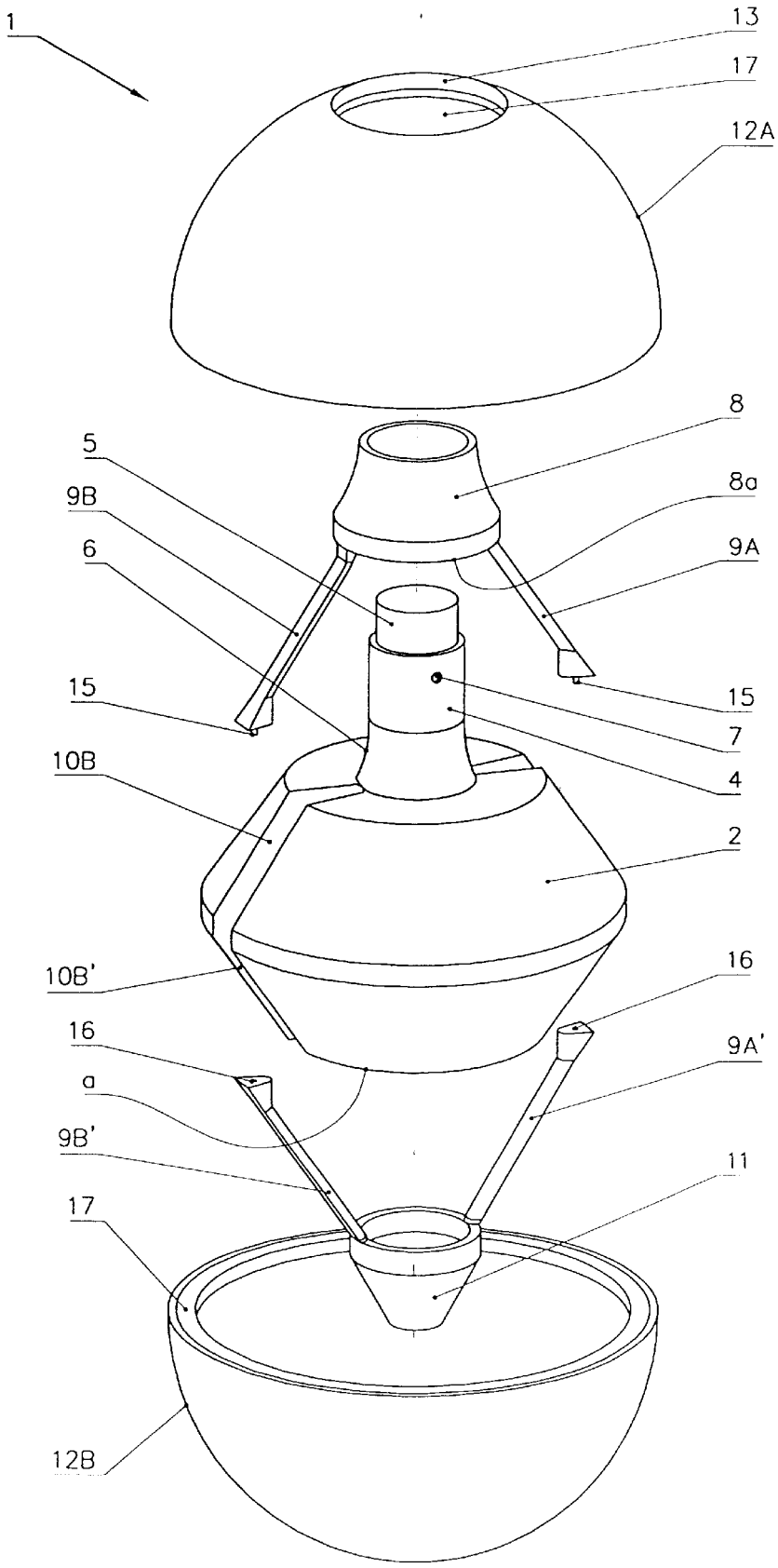
FIG. 3 is an exploded perspective view of a container according to the embodiment example of FIGS. 1 and 2.

According to one non-restrictive embodiment example, the upper activation arms 9A, 9B are connected with the lower activation arms 9A', 9B' by means of slugs 15 fitted on them and corresponding housings 16 fitted on the other (FIG. 3). This assembly could also be reinforced by glueing or another integralisation device.

Figure 4:
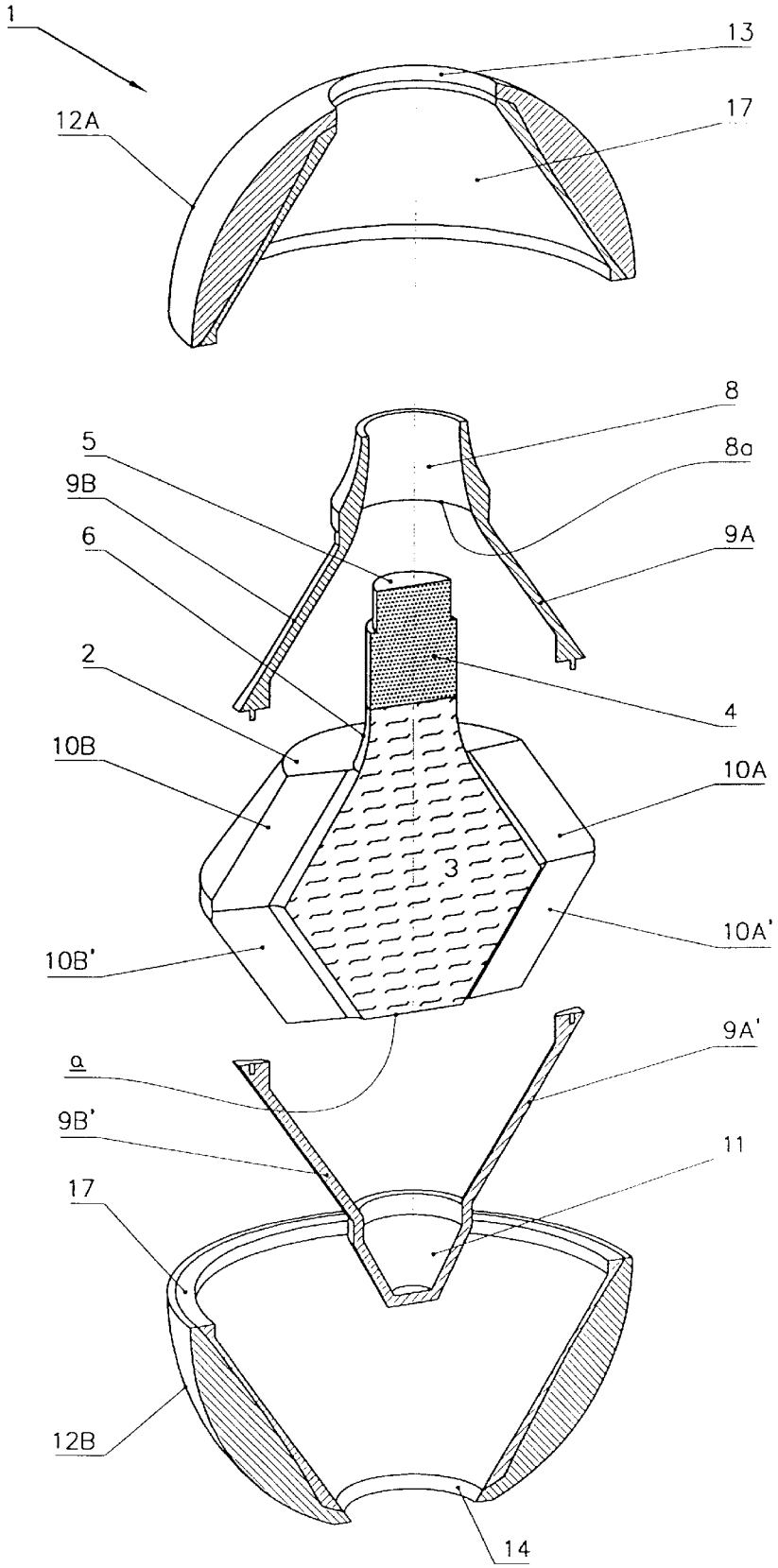
FIG. 4 is a longitudinal sectional view corresponding to the exploded perspective of FIG. 3.

Also, as clearly shown on FIGS. 3 and 4, the external spherical element is constituted by two distinct hemispheres 12A, 12B so as to incorporate the receptacle 2, as well as the sub-unit constituted by the sleeve 8 and the arms 9. The two hemispheres 12A, 12B are then assembled, for example, by glueing, ultrasonic weld, clipping, etc.

According to another characteristic of the invention, the sub-unit ensuring protection of the distributor end piece 4 constituted by the sleeve 8 and its activation arms 9 may comprise various locking means (not shown), in a closed position, enabling it to be safely carried.

Finally, as shown on the figures, the sphere 12 constituted by the hemispheres 12A, 12B may possibly receive an internal covering 17 doubling the sphere 12.

In this case, it is possible to imagine that the sphere 12 constituted by the hemispheres 12A, 12B would be transparent, whereas the internal covering 17 would comprise coloured faces, able to procure changes of colours, such as red with yellow reflections, or green with blue reflections, which would fluctuate according to the angle under which the container is viewed, so as to obtain special effects for decorative and aesthetic purposes.

It is clear that the example described above and which concerns a container whose receptacle has the shape of an upturned double truncated cone and whose external covering is basically spherical, could have other shapes, such as having a basically cylindrical, cubic or parallelpiped shape or all other shapes, without departing from the principle of the invention consisting of obtaining protection of the distribution end piece automatically, without requiring any manual, intervention by means of means activated at least solely by the inertia of their collective mass.

If necessary, the latter could be increased by ballasting the lengthening piece 11 linking the lower lateral arms 9A', 9B', initially provided hollow.

What is claimed is:

1. A dispensing container, comprising:

a receptacle (2) hermetically containing a product (3) in a liquid, gas, or pasty state to be distributed, an end piece (4) for distributing the product (3) embodied at an upper extremity portion of the receptacle (2) and constituted by a narrowed neck of the receptacle capable of opening and closing by a pump (4) mounted on a neck (6) and able to be activated manually by exerting pressure on a thrustor (5) comprising a spray nozzle, nozzle or delivery tube (7) for freeing the product (3);

a protecting means for the distribution end piece (4) comprising a sleeve (8) having a section with a corresponding shape and which is able to slide freely on said end piece (4) close to the upper extremity of the receptacle (2); activation means (9A, 9B, 9A', 9B') connected to said sleeve extending freely to the other opposite extremity of the receptacle (2) beyond its lower plane (a) so as to constitute with the sleeve (8)

sub-unit (8-9-11) forming a certain mass free on ascending or descending with respect to the receptacle (2) wherein said sleeve (8) automatically ensures protection via the lateral peripheral covering of the end piece (4) when the container (1) is laid on the fixed support (b) or when the container (1) is freed at least under the sole effect of the weight of the sub unit (8-9) when it is lifted up from said support (b) during use wherein the activation means are constituted by at least two diametrical lateral arms (9A, 9B) prolonging the sleeve (8) at its lower portion (8*a*) and rejoining via two opposing arms (9A', 9B') under the receptacle (2) they surround and with respect to which they slide freely by means of two corresponding slides (10A, 10B–10A', 10B') fitted on the external lateral faces of said receptacle (2) and with which they co-operate.

2. Container according to claim 1, characterised in that the lateral arms (9A, 9B and 9A', 9B') constituting the means for activating the sleeve (8) are inscribed in a geometric figure identical to that in which the corresponding slides (10A, 10B and 10A', 10B') of the receptacle (2) are inscribed, their spacing c in the transverse direction, for a given contact line (w), being approximately corresponding to that of the bottom of the slides they marry, when a play (j) is provided in the axial direction, equivalent to the desired travel and which is at least equal to the height (h) of the distributor end piece (4) to be protected or freed.

3. Container according to claim 2, characterised in that the total height (H) of the sub-unit formed by the upper lateral arms (9A, 9B) topped by the sleeve (8) and by the lower lateral arms (9A', 9B'), that is the height between the top of the sleeve (8) and the opposing extremities of the lower lateral arms (9A', 9B') is at least equal to the sum of the height (H1) of the receptacle (2), distributor end piece (4) included, and the vertical play (j) predetermined according to the value of the desired sliding of the protection sleeve (8).

4. Container according to claim 3, characterized in that the geometric figure in which the receptacle (2) is inscribed, is basically constituted by two truncated cones (2*a,* 2*b*) meeting together via their large circular base (2*e*) whose base lengths (L) are identical, the small base (2*c*) of one (2*b*) being closed and constituting the bottom of the receptacle (2), whereas the small base (2*d*) of the other (2*a*) is open so as to jointly receive the end piece of the distributor (4).

5. Container according to claim 3 characterized in that the geometric figure, in which the activation arms (9A, 9B, 9A', 9B') of the sleeve (8) are inscribed, is basically constituted by a cylindrical rhombus topped by of said sleeve (8) and re-united at their lower extremities by a truncated lengthening piece (11).

6. Container according to claim 3, characterized in that the receptacle (2) partially surrounded with the sleeve (8)/activation arm (9) sub-unit is contained on a generally spherical-shaped external element (12A, 12B) constituting both a decorative covering of the unit and a grasping of the latter, said external decorative element (12A, 12B) fixedly containing the receptacle (2) of the product (3), only the sleeve (8)/activation arm (9) sub-unit being free to slide there axially from bottom to top or vice versa, firstly via its clearance play (i) in the grooves (10) of said receptacle (2) and via an upper concentric opening (13) via which distributor end piece (4) opens permanently and the sleeve (8) according to an occasional frequency, and secondly by means of a lower concentric opening (14) through which the lengthening piece (11), formed at the opposing extremities of the activation arms(9A, 9B) of said sleeve (8) opens according to the same occasional frequency.

7. Container according to claim 3 characterized in that the sub-unit ensuring protection of the distributor end piece (4) constituted by the sleeve (8) and its activation arms (9) comprises various locking means in a closing position.

8. Container according to claim 2, characterised in that the geometric figure in which the receptacle (2) is inscribed, is basically constituted by two truncated cones (2*a,* 2*b*), meeting together via their large circular base (2*e*) whose base lengths (L) are identical, the small base (2*c*) of one (2*b*) being closed and constituting the bottom of the receptacle (2), whereas the small base (2*d*) of the other (2*a*) is open so as to jointly receive the end piece of the distributor (4).

9. Container according to claim 8 characterized in that the geometric figure, in which the activation arms (9A, 9B, 9A', 9B') of the sleeve (8) are inscribed, is basically constituted by a cylindrical rhombus topped by of said sleeve (8) and re-united at their lower extremities by a truncated lengthening piece (11).

10. Container according to claim 8, characterized in that the receptacle (2) partially surrounded with the sleeve (8)/activation arm (9) sub-unit is contained on a generally spherical-shaped external element (12A, 12B) constituting both a decorative covering of the unit and a grasping of the latter, said external decorative element (12A, 12B) fixedly containing the receptacle (2) of the product (3), only the sleeve (8)/activation arm (9) sub-unit being free to slide there axially from bottom to top or vice versa, firstly via its clearance play (i) in the grooves (10) of said receptacle (2) and via an upper concentric opening (13) via which distributor end piece (4) opens permanently and the sleeve (8) according to an occasional frequency, and secondly by means of a lower concentric opening (14) through which the lengthening piece (11), formed at the opposing extremities of the activation arms(9A, 9B) of said sleeve (8) opens according to the same occasional frequency.

11. Container according to claim 8 characterized in that the sub-unit ensuring protection of the distributor end piece (4) constituted by the sleeve (8) and its activation arms (9) comprises various locking means in a closing position.

12. Container according to claim 2 characterized in that the sub-unit ensuring protection of the distributor end piece (4) constituted by the sleeve (8) and its activation arms (9) comprises various locking means in a closing position.

13. Container according to claim 2 characterised in that the geometric figure, in which the activation arms (9A, 9B, 9A', 9B') of the sleeve (8), are inscribed, is basically constituted by a cylindrical rhombus topped by of said sleeve (8) and re-united at their lower extremities by a truncated lengthening piece (11).

14. Container according to claim 13, characterized in that the receptacle (2) partially surrounded with the sleeve (8)/activation arm (9) sub-unit is contained on a generally spherical-shaped external element (12A, 12B) constituting both a decorative covering of the unit and a grasping of the latter, said external decorative element (12A, 12B) fixedly containing the receptacle (2) of the product (3), only the sleeve (8)/activation arm (9) sub-unit being free to slide there axially from bottom to top or vice versa, firstly via its clearance play (i) in the grooves (10) of said receptacle (2) and via an upper concentric opening (13) via which distributor end piece (4) opens permanently and the sleeve (8) according to an occasional frequency, and secondly by means of a lower concentric opening (14) through which the lengthening piece (11), formed at the opposing extremities of the activation arms(9A, 9B) of said sleeve (8) opens according to the same occasional frequency.

15. Container according to claim 13 characterized in that the sub-unit ensuring protection of the distributor end piece (4) constituted by the sleeve (8) and its activation arms (9) comprises various locking means in a closing position.

16. Container according to claim 2, characterised in that the receptacle (2) partially surrounded with the sleeve (8)/activation arm (9) sub-unit is contained on a generally spherical-shaped external element (12A, 12B) constituting both a decorative covering of the unit and a grasping of the latter, said external decorative element (12A, 12B) fixedly containing the receptacle (2) of the product (3), only the sleeve (8)/activation arm (9) sub-unit being free to slide there axially from bottom to top or vice versa, firstly via its clearance play (j) in the grooves (10) of said receptacle (2) and via an upper concentric opening (13) via which the distributor end piece (4) opens permanently and the sleeve (8) according to an occasional frequency, and secondly by means of a lower concentric opening (14) through which the lengthening piece (11), formed at the opposing extremities of the activation arms (9A, 9B) of said sleeve (8) opens according to the same occasional frequency.

17. Container according to claim 16 characterized in that the sub-unit ensuring protection of the distributor end piece (4) constituted by the sleeve (8) and its activation arms (9) comprises various locking means in a closing position.

18. Container according to claim 1, characterised in that the sub-unit ensuring protection of the distributor end piece (4) constituted by the sleeve (8) and its activation arms (9) comprises various locking means in a closing position.

19. A dispenser, comprising:

a housing having a top opening;

a sleeve having a top opening slidably retained in said housing and shiftable between a first position and a second position, said sleeve automatically shifting to said first position when said dispenser rests on a support surface and automatically shifting to said second position when said dispenser is lifted from said support surface relative to said housing; and, a receptacle for holding a dispensable material disposed within said sleeve and including a nozzle for dispensing said material, said nozzle being located beneath said top opening when said dispenser is in said first position and automatically extending from said top opening when said dispenser is in said second position.

20. The dispenser of claim 19 wherein said housing further comprises an upper inner wall portion and a lower inner wall portion, said sleeve further comprising:

a pair of upper arms; and, a pair of lower arms having a first end attached to said pair of upper arms, and a second end attached to an end weight, said upper arms engaging against said upper inner wall portion when said dispenser is in said first position, and said lower arms engaging against said lower inner wall portion when said dispenser is in said second position.

* * * * *